United States Patent [19]

Disch et al.

[11] 4,175,062

[45] Nov. 20, 1979

[54] AQUEOUS CLEANSER COMPOSITIONS

[75] Inventors: Karlheinz Disch, Haan; Eva Kiewert, Düsseldorf, both of Fed. Rep. of Germany

[73] Assignee: Henkel Kommanditgesellschaft auf Aktien (Henkel KgaA), Dusseldorf, Fed. Rep. of Germany

[21] Appl. No.: 883,685

[22] Filed: Mar. 6, 1978

[30] Foreign Application Priority Data

Mar. 5, 1977 [DE] Fed. Rep. of Germany ..... 2709690

[51] Int. Cl.[2] ..... C11D 3/065; C11D 1/83

[52] U.S. Cl. ..... 252/540; 252/121; 252/173; 252/535; 252/554; 252/559

[58] Field of Search ..... 252/121, 173, 535, 540, 252/554, 559

[56] References Cited

U.S. PATENT DOCUMENTS

| | | | |
|---|---|---|---|
| 3,779,934 | 12/1973 | Altenschopfer et al. | 252/142 |
| 3,936,317 | 2/1976 | Lehmann et al. | 252/173 |
| 3,993,605 | 11/1976 | Scholz-Weigl et al. | 252/535 |
| 4,065,409 | 12/1977 | Flanagan | 252/173 |
| 4,082,684 | 4/1978 | Kreischer | 252/173 |

*Primary Examiner*—Mayer Weinblatt

*Attorney, Agent, or Firm*—Hammond & Littell

[57] ABSTRACT

Liquid cleanser compositions for cleaning hard surfaces comprising an aqueous solution containing from 2 to 30% by weight of a mixture consisting of:

(a) adducts of 3 to 30 mols of ethylene oxide onto vicinal alkanediols having 10 to 20 carbon atoms or monoalkyl ethers of said alkanediols with 1 to 4 carbon atoms in the alkyl, and (b) linear alkylbenzene sulfonic acids and/or linear alkane sulfonic acids, each with 8 to 20 carbon atoms in the alkyl or alkane, and their water-soluble salts, in a weight ratio of a:b of from 1:1 to 1:20.

11 Claims, No Drawings

AQUEOUS CLEANSER COMPOSITIONS

BACKGROUND OF THE INVENTION

The use of modern, easy-to-clean, prefabricated kitchen, bathroom and cellar furnishings, furniture with plastic veneer, and the increasing use of freezer chests, refrigerators, washers and dishwashers, that is, household appliances with enameled metal walls with large surfaces, have led to a steep increase in the demand of liquid all-purpose cleansers for the household in the last few years. The use of such agents has gained in importance in industrial and hospital use as well. The application of these all-purpose liquid cleansers must be as simple and uncomplicated as possible. Most of these products are offered preferably as aqueous concentrates. They can be applied diluted or undiluted to a moist, absorbent cloth of any desired texture or to a sponge with which the hard surfaces of metal, lacquered wood, plastics, ceramic products, such as porcelain, tiles, glazed tiles, glass, etc., are wiped to remove dust, greasy dirt and spots. It is desirable that this treatment of surfaces does not leave any spots and streaks behind due to the cleanser and does not require subsequent treatment with a cloth moistened with clear water (rinse treatment).

Such cleansers in the form of more or less dilute solutions or concentrates with a content of capillary-active adducts obtained by the reaction of ethylene oxide with 1,2-glycols having 8 to 26 carbon atoms in the molecule, are described in Swiss Pat. No. 433,768 (corresponding to U.S. Pat. No. 3,406,208). In addition, these cleaners may also contain, among others, possibly amounts of anionic surface-active compounds or tensides, such as alkyl benzenesulfonates.

Cleansers containing, as active tensides, an ethoxylated mixture of non-terminal vicinal alkanediols or also partially etherified non-terminal vicinal alkanediols with hydroxyl or also hydroxyl-alkoxyl groups are described in the German published patent application DOS No. 1,910,765 (corresponding to U.S. Pat. No. 3,758,410). Such products are suitable for the cleaning of textiles made of cotton or synthetic materials, such as polyesters or of mixtures of cotton and polyesters. The statement is made that the active tenside mentioned in this patent can also be mixed with anionic tensides, such as, for example, alkylaryl sulfonates, in which case the sulfonates must be present in this mixture in at least equal proportions, preferably, however, in a large excess. Practical examples for such mixtures are not given in this publication. It is merely shown with comparison trials that these active tensides, which are claimed to be novel there, possess better properties for the cleaning of textiles than a sodium alkylbenzene sulfonate. However, no mention of the possible utilization of the mentioned tensides for inclusion in liquid cleaners for hard surfaces, neither alone nor in combination, can be found in this patent.

Clear rinse agents for the cleaning of dishes in machine dishwashers without leaving spots, consisting of a liquid mixture of adducts of ethylene oxide to aliphatic non-terminal vicinal alkanediols with a linear alkyl chain of 10 to 20 carbon atoms with hydroxyl groups statistically distributed around a median value with the main amount in the center of the carbon atoms chain and foam-suppressing nonionic alkylene oxide adducts to higher alkanols, alkanediols and alkylphenols, as well as their formaldehyde acetals are described in Austrian Pat. No. 329,722 and U.S. Pat. No. 3,779,934. Mixtures with anionic tensides are not considered. The problems of spotless rinsing in the cleaning of dishes in the dishwasher an in the manual cleaning of hard surfaces in the household are largely different so that, as a rule, information derived from knowledge about one product and its effectiveness in one field cannot be applied to another field.

OBJECTS OF THE INVENTION

An object of the present invention is the development of a liquid cleanser composition for cleaning hard surfaces which readily removes dirt and grime therefrom without scrubbing and without leaving streaks or spots on drying.

Another object of the present invention is the development of liquid cleanser compositions for cleaning hard surfaces consisting of an aqueous solution containing:

(1) from 2% to 30% by weight of a tenside mixture consisting of:

(a) adducts of 3 to 30 mols of ethylene oxide onto alcohols selected from the group consisting of aliphatic vicinal alkanediols having 10 to 20 carbon atoms and monoalkyl ethers of said alkanediols having 1 to 4 carbon atoms in the alkyl, and (b) anionic sulfonic compounds selected from the group consisting of linear alkylbenzene sulfonic acids having 8 to 20 carbon atoms in the alkyl, linear alkane sulfonic acids having 8 to 20 carbon atoms, mixtures of said acids, and water-soluble salts of said acids selected from the group consisting of alkali metal salts, alkaline earth metal salts and ammonium salts, where the ratio of a:b is from 1:1 to 1:20, (2) from 0 to 3% by weight of a water-soluble salt of a fatty acid having from 12 to 18 carbon atoms, and (3) from 0 to 30% by weight of other customary liquid cleanser ingredients selected from the group consisting of polymeric phosphates, organic sequestering agents, wash alkalis, sodium sulfate, soil suspension agents, hydrotropic agents, organic solvents, dyes, odorants and antimicrobial agents, having a pH in the range of 7.0 to 10.5 as a 2% solution.

These and other objects of the invention will become more apparent as the description thereof proceeds.

DESCRIPTION OF THE INVENTION

Completely unexpectedly in view of the background of the invention, applicants have discovered that combinations of specific amounts of ethoxylated alkanediols or their monoalkyl ethers as nonionic tensides and alkaryl sulfonates and/or alkane sulfonates as anionic tensides possess a synergistic cleaning effect exceeding to an unexpected degree the effect of the individual components during their application in substantially equal amounts.

The present invention, therefore, relates to a liquid cleanser for hard surfaces in the form of more or less dilute, preferably aqueous, solutions wth a content of nonionic adducts of ethylene oxide to aliphatic vicinal diols, or partially etherified diols with linear alkyl chain of 10 to 20 carbon atoms, anionic tensides as well as other conventional components of such cleansers, if desired, characterized by the fact that it has as a content of nonionic adducts and anionic tensides 2% to 30%, preferably 5% to 15%, by weight of a mixture consisting of:

(a) adducts of 3 to 30, preferably 4 to 20, especially 5 to 10 moles of ethylene oxide onto aliphatic vicinal alkanediols with a linear alkyl chain of 10 to 20, preferably 11 to 18, carbon atoms, or their monoalkyl ethers with 1 to 4, preferably 1 to 2, carbon atoms in the alkyl ether group, and (b) linear alkylbenzene sulfonic acids and/or linear alkane sulfonic acids each with 8 to 20 carbon atoms in the alkyl group or their water-soluble alkali metal and alkaline earth metal and/or ammonium salts at a ratio of a:b of 1:1 to 1:20, preferably 1:2 to 1:10.

More particularly, the present invention relates to liquid cleanser compositions for cleaning hard surfaces consisting of an aqueous solution containing:

(1) from 2% to 30% by weight of a tenside mixture consisting of:

(a) adducts of 3 to 30 mols of ethylene oxide onto alcohols selected from the group consisting of aliphatic vicinal alkanediols having 10 to 20 carbon atoms and monoalkyl ethers of said alkanediols having 1 to 4 carbon atoms in the alkyl, and (b) anionic sulfonic compounds selected from the group consisting of linear alkylbenzene sulfonic acids having 8 to 20 carbon atoms in the alkyl, linear alkane sulfonic acids having 8 to 20 carbon atoms, mixtures of said acids, and water-soluble salts of said acids selected from the group consisting of alkali metal salts, alkaline earth metal salts and ammonium salts, where the ratio of a:b is from 1:1 to 1:20, (2) from 0 to 3% by weight of a water-soluble salt of a fatty acid having from 12 to 18 carbon atoms, and (3) from 0 to 30% by weight of other customary liquid cleanser ingredients selected from the group consisting of polymeric phosphates, organic sequestering agents, wash alkalis, sodium sulfate, soil suspension agents, hydrotropic agents, organic solvents, dyes, odorants and antimicrobial agents, having a pH in the range of 7.0 to 10.5 as a 2% solution.

The nonionic adducts used in the liquid cleansers of the invention are prepared in a well-known manner by the addition of 3 to 30, preferably 4 to 20, and especially 5 to 10, mols of ethylene oxide onto higher molecular weight terminal or non-terminal aliphatic vicinal alkanediols with a linear $C_{10}$–$C_{20}$, preferably $C_{11}$–$C_{18}$, alkyl chain or their monoalkyl ethers with 1 to 4 carbon atoms in the alkyl ether group, which reaction is carried out preferably at elevated temperatures of approximately 50° to 200° C. at atmospheric pressure or elevated pressure. The reaction is generally accelerated by basic or acidic catalysts. The epoxy alkanes used as starting materials for the preparation of the alkanediols are obtained in a known manner from the respective olefins or olefin mixtures. The terminal α- or 1,2-epoxy alkanes are obtained via α-mono-olefins, which are obtained, for example, by polymerization of ethylene with organic aluminum compounds as catalysts or by the thermal cracking of paraffin wax. Of the terminal mono-olefins, those with chain lengths in the area $C_{12}$–$C_{18}$ were used preferably. The non-terminal epoxy alkanes can be obtained, for example, by preparing them from linear aliphatic olefins with 10 to 20 carbon atoms and an internal double bond, by epoxidation with peracids or lower carboxylic acids and hydrogen peroxide forming peracids in situ and subsequent saponification of the epoxides with low-molecular-weight alcohols or glycols, or also by epoxidation of the olefin mixtures that were obtained by catalytic dehydration or by chlorination and dehydrochlorination of linear paraffins and selective extraction of the mono-olefins. Mono-olefins with internal double-bonds can also be prepared by the isomerization of α-olefins. Such olefins with the double-bond located approximately in the center of the carbon chain are used preferably as starting material. The products obtained usually are mixtures of various alkanediols or alkanediol-monoalkyl ethers or alkanediol-monohydroxyalkyl ethers.

Preferably non-terminal mono-olefins of a $C_{11}$–$C_{14}$ fraction and a $C_{15}$–$C_{18}$ fraction were employed having the following chain length distribution:

$C_{11}$–$C_{14}$ Fraction:

$C_{11}$-olefins approximately 22 wt. %
$C_{12}$-olefins approximately 30 wt. %
$C_{13}$-olefins approximately 26 wt. %
$C_{14}$-olefins approximately 22 wt. %

$C_{15}$–$C_{18}$ Fraction:

$C_{15}$-olefins approximately 26 wt. %
$C_{16}$-olefins approximately 35 wt. %
$C_{17}$-olefins approximately 32 wt. %
$C_{18}$-olefins approximately 7 wt. %

Preparation of the non-terminal adducts are described more particularly in U.S. Pat. No. 3,779,934.

The alkaryl sulfonic acids, preferably alkylbenzene sulfonic acids as well as their alkali metal, alkaline earth metal and ammonium salts are those whose alkyl group has 10 to 18, especially 11 to 14, carbon atoms in a linear chain, for example, sodium dodecylbenzene sulfonate, ammonium dodecylbenzene sulfonate, sodium tridecylbenzene sulfonate, magnesium dodecylbenzene sulfonate, sodium tetradecylbenzene sulfonate, lithium pentadecylbenzene sulfonate, etc. In addition, other alkaryl sulfonic acids and their salts may be employed, such as dialkylbenzene sulfonic acids and their salts having a total of 10 to 18 carbon atoms in the dialkyl, such as ammonium dodecyltoluene sulfonate, sodium dioctylbenzene sulfonate, etc.; alkylbenzene disulfonic acids and their salts, such as disodium dodecylbenzene disulfonate; alkylnaphthalene sulfonic acids and their salts having 10 to 18 carbon atoms in the alkyl; dialkylnaphthyl-naphthalene disulfonic acids and their salts having 3 to 12 carbon atoms in the alkyls, such as disodium diisopropylnaphthylnaphthalene disulfonate; and similar compounds. The sodium salts of the alkylbenzene sulfonic acids are preferred. However, at least a part of the alkaryl sulfonates can be replaced by the free alkylbenzene sulfonic acids and subsequently neutralized in situ, for example, by the addition of ammonia in a corresponding amount.

The alkane sulfonic acids and their alkali metal, alkaline earth metal and ammonium salts are especially those with a secondary sulfonic acid group and linear alkyl chain of 8 to 20, especially 12 to 18 carbon atoms. The ammonium, potassium and sodium salts are preferred. A part of the salts can be replaced by the use of free alkane sulfonic acids, also, with the subsequent neutralization again brought about by the addition of alkalis or ammonia in the required amount.

The advantageous properties of the claimed cleanser combination are observed even when they are used in the form of their aqueous solutions without any further additives. They can, of course, be used together with other components normally used for such cleansers, as indicated in the following description.

Inorganic or organic compounds with an alkaline reaction in their totality, especially inorganic or organic complexing or sequestering agents, which are present preferably in the form of their alkali metal or amine salts, especially the potassium salt, are used as builders for the liquid cleansers according to the invention. Also included among the builders are the alkali metal hydroxides of which potassium hydroxide is used preferably. In addition to the above builders for liquid cleansers, they can also contain wash alkalis, which act as builders and inert fillers, such as sodium sulfate or sodium or potassium chloride.

Polymeric phosphates with an alkaline reaction, especially the tripolyphosphates as well as the pyrophosphates are especially suitable as inorganic complexing or sequestering agents. They can be replaced completely or partially by organic complexing or sequestering agents.

Other inorganic builders that are suitable according to the invention are, e.g., the bicarbonates, carbonates, borates, silicates or orthophosphates of the alkali metals, sometimes called wash alkalis.

The organic complexing or sequestering agents include those of the type of the aminopolycarboxylic acids, such as, among others, nitrilotriacetic acid
ethylenediamine tetraacetic acid
N-hydroxyethyl ethylenediamine triacetic acid
polyalkylene polyamine-N-polycarboxylic acids.

In addition, methylenediphosphonic acid
1-hydroxyethane-1,1-diphosphonic acid
propane-1,2,3-triphosphonic acid
butane-1,2,3,4-tetraphosphonic acid
polyvinylphosphonic acid
mixed polymerizates of vinylphosphonic acid and acrylic acid
ethane-1,2-dicarboxy-1,2-diphosphonic acid
ethane-1,2-dicarboxy-1,2-dihydroxydiphosphonic acid
phosphonosuccinic acid
1-aminoethane-1,1-diphosphonic acid
amino-tri-(methylenephosphonic acid)
methylamino-di-(methylene-phosphonic acid)
ethylamino-di-(methylene-phosphonic acid, as well as
ethylenediamine-tetra-(methylene-phosphonic acid)

are examples of di- and polyphosphonic acids which are useful as organic sequestering agents.

The most varied polycarboxylic acids, mostly without N or P, have been recommended as builders in the recent literature, with many but not all of these being polymerizates containing carboxyl groups. A large number of these carboxylic acids possess the ability to form a complex with calcium. These are, for example, citric acid, tartaric acid, benzene-hexacarboxylic acid, tetrahydrofuran-tetracarboxylic acid, etc. Polycarboxylic acids containing carboxymethyl ether groups are also suitable, such as, for example:

diglycolic acid
2,2'-oxydisuccinic acid,
polyvalent alcohols or hydroxycarboxylic acids etherified partially or completely with glycolic acid, for example:
bis-(O-carboxymethyl)-ethylene glycol
bis-(O-carboxymethyl)-diethylene glycol
1,2-bis-(O-carboxymethyl)-glycerine
tris-(O-carboxymethyl)-glycerine,
mono-(O-carboxymethyl)-glyceric acid
bis-(O-carboxymethyl)-glyceric acid
mono-(O-carboxymethyl)-tartaric acid
bis-(O-carboxymethyl)-tartaric acid
mono-(O-carboxymethyl)-erythronic acid
tris-(O-carboxymethyl)-2,2-dihydroxymethyl propanol
tris-(O-carboxymethyl)-2,2-dihydroxymethylbutanol
mono-(O-carboxymethyl)-trihydroxyglutaric acid
bis-(O-carboxymethyl)-trihydroxyglutaric acid, as well as
carboxymethylated or oxidized polysaccharides.

Examples of polycarboxylic acids of the polymerizate type are poly-α-hydroxyacrylic acid; mixed polymerizates of maleic acid and tetrahydrofuran; polymerizates of maleic acid, itaconic acid, mesaconic acid, fumaric acid, aconitic acid, methylenemalonic acid and citraconic acid, as well as mixed polymerizates of these acids among one another or with other substances that can be polymerized, for example, with ethylene, propylene, acrylic acid, methacrylic acid, crotonic acid, 3-butene carboxylic acid, 3-methyl-3-butene carboxylic acid as well as with vinyl methyl ether, vinyl acetate, isobutylene, acrylamide and styrene.

The polyhydroxycarboxylic acids and polyformylcarboxylic acids are also obtained by polymerization, which acids are practically not cross-linked, contain mainly straight-chain carbon-to-carbon bonds in the main chain and are formed mainly from ethylene units having one carboxyl, one formyl, one hydroxymethyl or one hydroxyl group each. The polyhydroxycarboxylic acids have a ratio of carboxyl groups to hydroxyl groups of 1.1:15, preferably 2:9 and a degree of polymerization of preferably 3 to 600. They can be prepared, for example, by copolymerization of acrolein and acrylic acid in the presence of hydrogen peroxide and subsequent Cannizaro conversion (German patent application DOS No. 1,904,941). The polyformylcarboxylic acids have a ratio of at least 1 of the carboxyl to the formyl groups and a degree of polymerization of preferably 3 to 100. The polymers may have terminal hydroxyl groups, if desired. They can be prepared, for example, by oxidative polymerization of acrolein with hydrogen peroxide (DOS No. 1,942,256).

Since cleaning products for the household generally are adjusted to almost neutral to weakly alkaline, i.e., their aqueous solutions ready for use have a pH in the range of 7.0 to 10.5, preferably 7.5 to 9.5, at concentrations of application between 2 and 20, preferably 5 to 15 gm/liter of water or aqueous solution, an addition of acid or alkali components may be required to regulate the pH. Preferably the liquid cleansers of the invention have a pH of 7.0 to 10.5 when diluted to a 2% by weight solution.

Suitable as acid reacting substances are conventional inorganic or organic acids or acid salts, such as hydrochloric acid, sulfuric acid, alkali metal bisulfates, aminosulfonic acid, phosphoric acid or other acids of phosphorus, especially the anhydric acids of phosphorus or their acid salts or their solid compounds with urea with an acid reaction or other low molecular weight carboxylic acid amides, partial amides of phosphoric acid or of anhydric phosphoric acid, citric acid, tartaric acid, lactic acid, etc.

In addition, inorganic or organic colloids or other water-soluble high-molecular-weight substances can be used as additives, particularly for their soil suspension effect, as well as their colloidal effect. These water-soluble organic colloids include polyvinyl alcohol, polyvinyl pyrrolidone, water-soluble derivatives of cellose or starch, such as carboxymethyl cellulose, ethers of cellulose and oxyalkyl sulfonic acids, as well as cellulose sulfates.

Well known solubilizers such as the water-soluble organic solvents, especially low-molecular-weight aliphatic alcohols with 1 to 4 carbon atoms, can be included in the liquid cleansers, as well as the so-called hydrotropic substances of the type of the lower aryl sulfonates, for example, toluene, xylene or cumenesulfonate.

They can also be in the form of their sodium and/or potassium and/or alkylolamine salts. Also useful as solubilizers are the water-soluble organic solvents, especially those with boiling points above 75° C., such as the ethers of identical or nonidentical polyhydric alcohols or the partial ethers of polyhydric and monohydric alcohols. These include di- or triethyleneglycol polyglycerines, as well as the partial ethers of ethylene glycol, propylene glycol, butylene glycol or glycerine with aliphatic monohydric alcohols containing 1 to 4 carbon atoms in the molecule.

Ketones, such as acetone, methylethyl ketone, as well as aliphatic, cycloaliphatic, aromatic and chlorinated hydrocarbons and the terpene alcohols may be used as water-soluble organic solvents or organic solvents that can be emulsified with water.

An addition of higher polyglycol ethers or polyglycerin or other water-soluble high-molecular-weight substances that are also known as soil suspension agents is recommended for the regulation of the viscosity, as desired. Also recommended for the regulation of the viscosity is an addition of sodium chloride and/or urea.

Furthermore, the claimed substances may contain additions of dyes and fragrances, preservatives and, if desired, antibacterially-active substances of any type.

Suitable as antimicrobially-active or antimicrobial substances are those compounds that are stable and active in the liquid products according to the invention. These are preferably phenolic compounds of the type of the halogenated phenols with 1 to 5 halogen substituents, especially chlorinated phenols; alkyl; cycloalkyl; aralkyl- and phenyl-phenols with 1 to 12 carbon atoms in the alkyl groups and with 1 to 4 halogen substituents, especially chlorine and bromine, in the molecule; alkylene bis-phenols with an alkylene bridge section with 1 to 10 carbon atoms, especially derivatives substituted with 2 to 6 halogen atoms and, optionally, with lower alkyl or trifluoromethyl groups; hydroxybenzoic acids or their esters and amides, especially anilides, which can be substituted, especially by 2 or 3 halogen atoms and/or trifluoromethyl groups in the benzoic acid and/or aniline group; orthophenoxyphenols that can be substituted by 1 to 7, preferably by 2 to 5, halogen atoms and/or the hydroxyl, cyano, methoxycarbonyl and carboxylic group or lower alkyls.

Especially preferred antimicrobial substances of the phenyl type are, for example:

O-phenylphenol
2-phenylphenol
2-hydroxy-2',4,4'-trichlorodiphenyl ether
3,4',5-tribromo-salicylanilide
3,3',5,5',6,6'-hexachloro-2,2'-dihydroxydiphenyl methane.

Other useful antimicrobial substances are the lower alcohols or diols with 3 to 5 carbon atoms and substituted by bromine as well as by the nitro group, for example:

2-bromo-2-nitropropanediol-1,3
1-bromo-1-nitro-3,3,3-trichloropropanol-2
2-bromo-2-nitrobutanol-1.

Furthermore, bis-diguanides, such as 1,6-bis-(p-chlorophenyldiguanido)-hexane in the hydrochloride, acetate or gluconate form as well as N,N'-disubstituted 2-thion-tetrahydro-1,3,5-thiadiazines, such as:

3,5-dimethyl-2-thion-tetrahydro-1,3,5-thiadiazine
3,5-diallyl-2-thion-tetrahydro-1,3,5-thiadiazine
3-benzyl-5-methyl-2-thion-tetrahydro-1,3,5-thiadiazine, and
especially 3-benzyl-5-carboxymethyl-2-thion-tetrahydro-1,3,5-thiadiazine are suitable as additional antimicrobial substances.

Condensation products of formaldehyde and amino alcohols may also be used. The products are prepared by the reaction of an aqueous formaldehyde solution with amino alcohols, e.g., 2-aminoethanol, 1-amino-2-propanol, 2-amino-iso-butanol, 2-(2'-aminoethyl)-aminoethanol.

The following examples are illustrative of the invention without being limitative in any manner.

CLEANSING EXPERIMENTS

The following experiments were performed to demonstrate the synergistic effect of the combination of the claimed compounds.

The aqueous solution of tenside combination to be tested for cleaning activity is applied to an artificially soiled plastic surface. A mixture of soot, machine oil, triglyceride of saturated fatty acids and low-boiling aliphatic hydrocarbon is used for the artificial soiling. The test area of 26×28 cm is coated uniformly with 2 gm of the artificial soil by means of a surface coater.

A synthetic sponge is saturated with 12 ml of the cleaning solution to be tested and moved mechanically on the test area. After six wiping motions, the cleaned test area is held under running water and the loosened soil is removed. The cleaning effect, that is, the degree of whiteness of the plastic surface cleaned in this manner is determined with a photoelectric colorimeter LF 90 (Dr. B. Lange). The clean, white plastic surface is used as white standard. Since the clean surface is taken as 100% and the soiled surface is 0 for the measurements, the values read for the cleaned plastic surfaces are calculated to the percentage value of cleaning power (% RV). The given % RV values are mean values of a four-time determination.

The aqueous solutions of a mixture of:

(a) addition compounds of 5 or 10 mols of ethylene oxide with aliphatic epoxides reacted with 1 mol of ethylene glycol or methanol and possessing a linear alkyl chain of 10 to 20 carbon atoms, and
(b) linear alkylbenzene sulfonates or linear alkane sulfonates are used for the subsequent experiments.

The tensides (a) and (b) are mixed at a ratio respective of 20:0 to 0:20. The concentration of the test solutions was about 5 gm/liter.

Test #1

In this test, a mixture of the addition product of 10 mols of ethylene oxide to a non-terminal $C_{15-18}$ epoxidized olefin reacted with one mol of ethylene glycol (Diol 15/18+11 EO) and the sodium salt of a linear $C_{11-14}$-alkylbenzene sulfonate (ABS) were employed in various ratios and their respective cleaning powers (% RV) were determined and reported in Table I.

TABLE 1

| uz,2/27 Tenside Mixture (a) : (b) | Ratio (a):(b) | Concentration gm/liter | % RV |
|---|---|---|---|
| Diol 15/18 + 11 EO : ABS | 20:0 | 5 | 68 |
| | 15:5 | 5 | 61 |
| | 10:10 | 5 | 83 |
| | 5:15 | 5 | 89 |
| | 2:18 | 5 | 86 |
| | 1:19 | 5 | 84 |
| | 0.20 | 5 | 81 |

The water value (blank value with tap water) was at 16% RV. It is apparent from the experimental data that a synergistic cleaning effect can be recorded with the mixtures diol 15/18+11 EO:ABS of 10:10 to 1:19.

Test #2

In Test #2, the ABS was replaced by the sodium salt of a linear $C_{14}$–$C_{18}$-alkyl sulfonate (AS) and the respective mixtures were tested for their cleaning effect and the results reported in Table 2.

TABLE 2

| Tenside Mixture (a) : (b) | Ratio (a):(b) gm/liter | Concentration % RV | |
|---|---|---|---|
| Diol 15/18 + 11 EO : AS | 20:0 | 5 | 68 |
| | 15:5 | 5 | 58 |
| | 10:10 | 5 | 60 |
| | 5:15 | 5 | 63 |
| | 2:18 | 5 | 79 |
| | 1:19 | 5 | 75 |
| | 0:20 | 5 | 71 |

The water value was at 15% RV. A synergistic potentiation of the cleaning effect of the mixtures 2:18 and 1:19 could be observed also in this test series.

Test #3

The cleaning effect of the mixtures of the addition product of 5 mols of ethylene oxide with internal $C_{15/18}$-epoxide reacted with 1 mol of ethylene glycol to give a mono-hydroxyethyl ether (Diol 15/18+6 EO), and the sodium salt of the liner $C_{11/14}$-alkylbenzene sulfonate (ABS) was determined. The values are reported in Table 3.

TABLE 3

| Tenside Mixture (a):(b) | Ratio (a):(b) | Concentration gm/liter | % RV |
|---|---|---|---|
| Diol 15/18 + 6 EO : ABS | 20:0 | 5 | 68 |
| | 15:5 | 5 | 56 |
| | 10:10 | 5 | 78 |
| | 5:15 | 5 | 91 |
| | 2:18 | 5 | 89 |
| | 1:19 | 5 | 86 |

TABLE 3-continued

| Tenside Mixture (a):(b) | Ratio (a):(b) | Concentration gm/liter | % RV |
|---|---|---|---|
| | 0:20 | 5 | 81 |

The water value was 15% RV. The results of this test series also demonstrated a synergistic effect with the mixtures 10:10 to 1:19.

Test #4

The cleaning effect of the mixtures of the addition product of 10 mols of ethylene oxide with the internal $C_{11/14}$-epoxide reacted with 1 mol of methanol to give a monomethyl ether (monomethyl ether diol 11/14+10 EO) and the sodium salt of the liner $C_{11/14}$-alkylbenzene sulfonate (ABS) was determined. The values are reported in Table 4.

TABLE 4

| Tenside Mixture (a):(b) | Ratio (a):(b) | Concentration gm/liter | % RV |
|---|---|---|---|
| Monomethyl ether diol 11/14 + 10 EO : ABS | 20:0 | 5 | 52 |
| | 15:5 | 5 | 51 |
| | 10:10 | 5 | 72 |
| | 5:15 | 5 | 85 |
| | 2:18 | 5 | 85 |
| | 1:19 | 5 | 83 |
| | 0:20 | 5 | 81 |

The water value is at 14% RV. The synergistic effect is observed with mixtures between 10:10 and 1:19.

The following are Examples of some of the liquid cleanser compositions of the invention. The same are not to be deemed limitative however.

EXAMPLE 1

| % by Weight | Ingredients |
|---|---|
| 8 | Sodium dodecylbenzene sulfonate |
| 1 | Non-terminal $C_{15/18}$-alkanediol + 11 EO |
| 4 | Sodium tripolyphosphate |
| 3 | Sodium cumene sulfonate |
| 0.2 | Perfume oil |
| 0.0015 | Dyes |
| Remainder | Water |

EXAMPLE 2

| % By Weight | Ingredients |
|---|---|
| 7.5 | Sodium dodecylbenzene sulfonate |
| 2.5 | Non-terminal $C_{11/14}$-alkanediol + 10.5 EO |
| 1.5 | Potassium soap of soybean oil fatty acids |
| 6.0 | Sodium tripolyphosphate |
| 5.0 | Ethylene glycol monobutyl ether |
| 4.0 | Sodium cumene sulfonate |
| 0.8 | Pine oil |
| 0.4 | Perfume oil |
| 0.003 | Dyes |
| Remainder | Water |

EXAMPLE 3

| % By Weight | Ingredients |
|---|---|
| 9.0 | $C_{11/14}$-alkane sulfonate, Na-salt |

-continued

| % By Weight | Ingredients |
|---|---|
| 1.0 | Non-terminal $C_{15/18}$-alkanediol + 11 EO |
| 3.0 | Ethylene diaminotetraacetic acid, Na-salt |
| 4.0 | Sodium cumene sulfonate |
| 5.0 | Ethanol |
| 0.3 | Perfume oil |
| Remainder | Water |

EXAMPLE 4

| % By Weight | Ingredients |
|---|---|
| 14.0 | Sodium dodecylbenzene sulfonate |
| 2.0 | Non-terminal $C_{15/18}$-alkanediol + 11 EO |
| 0.6 | Borax |
| 5.0 | Ethanol |
| 6.0 | Urea |
| 0.1 | 2',4,4'-trichloro-2-hydroxydiphenyl ether |
| 0.2 | Perfume oil |
| 0.002 | Dyes |
| Remainder | Water |

EXAMPLE 5

| % By Weight | Ingredients |
|---|---|
| 4.0 | Sodium dodecylbenzene sulfonate |
| 3.0 | $C_{11/14}$-alkane sulfonate, Na-salt |
| 1.5 | Non-terminal $C_{15/18}$-alkanediol + 10.5 EO |
| 5.0 | Sodium cumene sulfonate |
| 4.0 | Sodium tripolyphosphate |
| 4.0 | Ethylene glycol monobutyl ether |
| 2.0 | O-phenylphenol |
| 0.4 | Perfume oil |
| 0.001 | Dyes |
| Remainder | Water |

EXAMPLE 6

| % By Weight | Ingredients |
|---|---|
| 9.0 | Sodium dodecylbenzene sulfonate |
| 2.0 | Non-terminal $C_{15/18}$-alkanediol monomethyl ether + 10 EO |
| 3.0 | Sodium tripolyphosphate |
| 6.0 | Ethylene glycol monobutylether |
| 7.0 | Formaldehyde/aminoethanol condensation product |
| 5.0 | Sodium cumene sulfonate |
| 0.35 | Perfume oil |
| 0.002 | Dyes |
| Remainder | Water |

EXAMPLE 7

| % By Weight | Ingredients |
|---|---|
| 1.7 | Sodium hydroxide, 50% solution |
| 7.0 | Dodecylbenzene sulfonic acid |
| 3.0 | Non-terminal $C_{15/18}$-alkanediol + 8 EO |
| 4.5 | Sodium tripolyphosphate |
| 3.5 | Sodium cumene sulfonate |
| 4.0 | Ethylene glycol monobutyl ether |
| 0.25 | Perfume oil |
| 0.002 | Dyes |
| Remainder | Water |

The liquid cleansing products of the present invention are preferably within the limits of the following formulation:

| % By Weight | Ingredients |
|---|---|
| 6 to 9 | $C_{11/14}$-alkylbenzene sulfonic acid and/or $C_{12/18}$-alkane sulfonic acid and/or their water-soluble salts |
| 0.5 to 3 | $C_{10/20}$-alkanediol + (10 to 11) EO |
| 0 to 3 | Alkali metal or ammonium salt of $C_{12/18}$-fatty acids |
| 2.5 to 6 | Sodium tripolyphosphate |
| 0 to 6 Preferably 3 to 6) | Ethylene glycol monobutyl ether |
| 0 to 2 (Preferably 0.2 to 2) | Pine oil |
| 2 to 3 | Alkali metal cumene sulfonate |
| 0.2 to 0.6 | Perfume oil |
| 0.0005 to 0.005 | Dyes |
| 0 to 6 | Ethanol |
| Remainder | Water |

The pH of the products of this sample formulation is between 8.0 and 10.5.

The preceding specific embodiments are illustrative of the practice of the invention. It is to be understood, however, that other expedients known to those skilled in the art or disclosed herein may be employed without departing from the spirit of the invention and the scope of the appended claims.

We claim:

1. Liquid cleanser compositions for cleaning hard surfaces consisting essentially of an aqueous solution containing (1) from 2% to 30% by weight of a tenside mixture consisting of:

(a) adducts of 3 to 30 mols of ethylene oxide onto alcohols selected from the group consisting of aliphatic-vicinal alkanediols having 10 to 20 carbon atoms and monoalkyl ethers of said alkanediols having 1 to 4 carbon atoms in the alkyl, and (b) anionic sulfonic compounds selected from the group consisting of linear alkylbenzene sulfonic acids having 8 to 20 carbon atoms in the alkyl, linear alkane sulfonic acids having 8 to 20 carbon atoms, mixtures of said acids, and water-soluble salts of said acids selected from the group consisting of alkali metal salts, alkaline earth metal salts and ammonium salts, where the ratio of a:b is from 1:1 to 1:20, (2) from 0 to 3% by weight of a water-soluble salt of a fatty acid having from 12 to 18 carbon atoms, and having a pH in the range of 7.0 to 10.5 as a 2% solution.

2. The liquid cleanser composition of claim 1 wherein said ethylene oxide adduct has from 4 to 20 mols of ethylene oxide adducted thereon.

3. The liquid cleanser composition of claim 1 wherein said ethylene oxide adduct has from 5 to 10 mols of ethylene oxide adducted thereon.

4. The liquid cleanser composition of claim 1 wherein said adduct component (a) is the adduct of 5 to 10 mols of ethylene oxide onto alcohols selected from the group consisting of aliphatic, non-terminal vicinal alkanediols having 11 to 18 carbon atoms and monoalkyl ethers of said alkanediols having 1 to 2 carbon atoms in the alkyl.

5. The liquid cleanser composition of claim 1 wherein the ratio of a:b is from 1:2 to 1:10.

6. The liquid cleanser composition of claim 1 wherein said tenside mixture component (1) is present in an amount of from 5% to 15% by weight.

7. The liquid cleanser composition of claim 1 wherein said pH is from 7.5 to 9.5 as a 2% solution.

8. The liquid cleanser composition of claim 1 having a further content of up to 30% by weight of other customary liquid cleanser ingredients selected from the group consisting of polymeric phosphates, organic sequestering agents, wash alkalis, sodium sulfate, soil suspension agents, hydrotropic agents, organic solvents, dyes, odorants and antimicrobial agents.

9. The liquid cleanser composition of claim 1 wherein said anionic sulfonic compounds are selected from the group consisting of linear alkylbenzene sulfonic acids having 10 to 18 carbon atoms in the alkyl, linear alkane sulfonic acids having 12 to 18 carbon atoms, mixtures of said acids and water-soluble alkali metal and ammonium salts thereof.

10. The liquid cleanser compositions of claim 9 wherein said alkylbenzene sulfonic acids have from 11 to 14 carbon atoms in the alkyl.

11. A liquid cleanser composition for cleaning hard surfaces consisting essentially of an aqueous solution containing:

6% to 9% by weight of a sulfonate selected from the group consisting of alkali metal $C_{11}$–$C_{14}$-alkylbenzene sulfonates and alkali metal $C_{12}$–$C_{18}$-alkane sulfonates, 0.5% to 3% by weight of a $C_{10}$–$C_{20}$-alkanediol+-10–11 mols of ethylene oxide, 0 to 3% by weight of an alkali metal or ammonium soap of a $C_{12}$–$C_{18}$-fatty acid, 2.5% to 6% by weight of sodium tripolyphosphates, 0 to 6% by weight of ethylene glycol monobutyl ether, 0 to 2% by weight of pine oil, 2% to 3% by weight of alkali metal cumene sulfonate, 0.2% to 0.6% by weight of perfume oil, 0.0005% to 0.005% by weight of dyes, and 0 to 6% by weight of ethanol, and the remainder water.

* * * * *